US007407373B2

(12) United States Patent
Ogata et al.

(10) Patent No.: US 7,407,373 B2
(45) Date of Patent: Aug. 5, 2008

(54) INTERNAL GEAR PUMP AND AN INNER ROTOR OF SUCH A PUMP

(75) Inventors: Daisuke Ogata, Okayama (JP); Naoki Inui, Okayama (JP); Shinya Arinaga, Okayama (JP)

(73) Assignee: Sumitomo Electric Sintered Alloy, Ltd., Okayama (JP)

( * ) Notice: Subject to any disclaimer, the term of this patent is extended or adjusted under 35 U.S.C. 154(b) by 0 days.

(21) Appl. No.: 10/564,629

(22) PCT Filed: Jul. 7, 2004

(86) PCT No.: PCT/JP2004/009635

§ 371 (c)(1),
(2), (4) Date: Jan. 13, 2006

(87) PCT Pub. No.: WO2005/005835

PCT Pub. Date: Jan. 20, 2005

(65) Prior Publication Data

US 2006/0171834 A1 Aug. 3, 2006

(30) Foreign Application Priority Data

Jul. 15, 2003 (JP) ..... 2003-274844

(51) Int. Cl.
*F04C 18/00* (2006.01)
*F04C 2/00* (2006.01)

(52) U.S. Cl. ..... 418/171; 74/462; 475/180

(58) Field of Classification Search ..... 418/171, 418/166, 61.3, 206.5; 74/462; 475/180, 475/344

See application file for complete search history.

(56) References Cited

U.S. PATENT DOCUMENTS

| | | | | | |
|---|---|---|---|---|---|
| 1,516,591 | A * | 11/1924 | Edwards | 418/171 |
| 1,833,993 | A * | 12/1931 | Hill | 475/180 |
| 1,863,335 | A * | 6/1932 | Hill | 418/171 |
| 5,226,798 | A * | 7/1993 | Eisenmann | 418/171 |
| 5,368,455 | A * | 11/1994 | Eisenmann | 418/171 |
| 5,876,193 | A * | 3/1999 | Hosono et al. | 418/171 |
| 6,244,843 | B1 | 6/2001 | Kosuge | |
| 6,540,637 | B2 * | 4/2003 | Bachmann et al. | 475/162 |
| 2003/0072665 | A1 | 4/2003 | Bachmann et al. | |

FOREIGN PATENT DOCUMENTS

| | | |
|---|---|---|
| JP | 06-39109 | 10/1994 |
| RU | 2 113 643 C1 | 6/1998 |
| WO | WO 99/11935 | 11/1999 |

OTHER PUBLICATIONS

Chinese Office Action, with English Translation, issued in Chinese Patent Application No. CN 200480018532.2, issued on Jan, 11, 2008.

* cited by examiner

*Primary Examiner*—Theresa Trieu
(74) *Attorney, Agent, or Firm*—McDermott Will & Emery LLP

(57) ABSTRACT

An inner motor is structured to increase the discharge rate of an internal gear pump by making it possible to freely adjust the eccentricity e between the inner and outer rotors. Each tooth of the inner rotor includes a tooth bottom defined by hypocycloidal curves, an engaging portion to be brought into engagement with the outer rotor and defined by involute curves, and a tooth top defined by a predetermined curve such as a part of a circle or an oval or an epicycloidal curve.

4 Claims, 5 Drawing Sheets

INTERNAL GEAR PUMP AND AN INNER ROTOR OF SUCH A PUMP

RELATED APPLICATION

This application is a national phase of PCT/JP2004/009635 filed on Jul. 7, 2004, which claims priority from Japanese Application No. 2003-274844 which was filed on Jul. 15, 2003, the disclosures of which Applications are incorporated by reference herein. The benefit of the filing and priority dates of the International and Japanese Applications is respectfully requested.

TECHNICAL FIELD

This invention relates to an inner rotor of an internal gear pump having a unique tooth shape, and an internal gear pump comprising such an inner rotor and an outer rotor.

BACKGROUND ART

The following patent documents 1 and 2 show conventional internal gear pumps.

Patent document 1: JP utility model publication 6-39109

Patent document 2: U.S. Pat. No. 6,244,843 B1

The internal gear pump disclosed in Patent document 1 includes trochoidal internal gear rotors generated based on the diameter A of a base circle, the diameter B of a rolling circle, the diameter C of a locus circle and eccentricity e.

The internal gear pump disclosed in Patent document 2 comprises an inner rotor including epicycloidal tooth tops and hypocycloidal tooth spaces, and an outer rotor including hypocycloidal tooth tops and epicycloidal tooth spaces.

DISCLOSURE OF THE INVENTION

Problems to Which the Invention Seeks a Solution

In the arrangement of Patent document 1, the diameter of the circle that connects the tooth tops of the inner rotor is determined by the number of teeth of the inner rotor, projected eccentricity e (distance between the centers of the inner and outer rotors), the diameter A of the base circle, the diameter B of the rolling circle, and the diameter C of the locus circle. This means that if the diameter of the circle that connects the tooth tops of the inner rotor is predetermined to a fixed value, the eccentricity e is also determined and not changeable. Thus, it is impossible to increase the discharge rate of the pump. Since the theoretical discharge rate of the pump increases with the eccentricity e, in order to increase the discharge rate of the pump, it is essential that the eccentricity be determinable without restrictions.

In Patent document 2, too, since the tooth top and tooth bottom of each tooth are generated by a rolling circle that rolls on the base circle without sliding while being circumscribed about the base circle, and a rolling circle that rolls on the base circle without sliding while being inscribed in the base circle, respectively, the eccentricity e cannot be freely determined as in Patent document 1. Thus, it is impossible to increase the discharge rate of the pump.

An object of the present invention is to increase the discharge rate of an internal gear pump by making it possible to freely determine the eccentricity of the rotors of the pump.

Means to Solve the Problems

According to the present invention, there is provided an inner rotor for an internal gear pump including a plurality of teeth each comprising a tooth bottom defined by hypocycloidal curves, an engaging portion configured to engage an outer rotor and defined by involute curves, and a tooth top defined by a predetermined curve.

The engaging portion refers to the portion of each tooth where the inner rotor meshes with the outer rotor when the inner and outer rotors are rotated at projected eccentric positions.

From another aspect of the invention, there is provided an internal pump comprising the inner rotor as described above, and an outer rotor having a plurality of teeth which are in the shape of an envelope f tooth contours of the inner rotor when the center of the inner rotor is rotated about the center of the outer rotor along a circle having a diameter of (2e+t), where e is the distance between the centers of the inner rotor and the outer rotor, and t is a maximum gap defined between the outer rotor and the inner rotor when the inner rotor is pressed against the outer rotor, while the inner rotor is rotated about the center of the inner rotor by 1/n, where n is the number of teeth of the inner rotor, of one full rotation of the inner rotor every time the center of the inner rotor rotates once about the center of the outer rotor.

Preferably, the inner rotor is designed such that a base circle of the hypocycloidal curves has a diameter greater than a base circle of the involute curves, each of the hypocycloidal curves of the tooth bottom connecting with one of the involute curves of the engaging portion at a point inside of the base circle of the hypocycloidal curves, and wherein a tangent, at the point, to a circle having a center at the center of the inner rotor and passing the point forms an angle smaller than 85 degrees with respect to a tangent to the involute curve at the point.

The predetermined curve defining the tooth top may be a part of a circle or an oval, but is preferably an epicycloidal curve.

ADVANTAGES OF THE INVENTION

According to the present invention, the engaging portion of each tooth of the inner rotor, which is provided between the tooth bottom and the tooth top, is defined by involute curves. Unlike trochoidal internal gear rotors and cycloidal internal gear rotors, involute curves are not generated by the locus of a point of a circle when the circle rolls on a base circle. Thus, such involute curves can be generated independently of the eccentricity e. Thus, the eccentricity e can be freely determined. This means that the discharge rate of the pump can be increased by increasing the eccentricity e.

By designing the inner rotor such that a base circle of the hypocycloidal curves has a diameter greater than a base circle of the involute curves, each of the hypocycloidal curves of the tooth bottom connecting with one of the involute curves of the engaging portion at a point inside of the base circle of the hypocycloidal curves, and wherein a tangent, at the point, to a circle having a center at the center of the inner rotor and passing the point forms an angle smaller than 85 degrees with respect to a tangent to the involute curve at the point, the inner rotor can be smoothly brought into meshing engagement with the outer rotor.

By defining each tooth top with an epicycloidal curve, it is possible to minimize gaps at the sealed portions of the pump, and thus to improve the volumetric efficiency of the pump. Such an epicycloidal tooth top can be smoothly connected to the involute engaging portion, so that the tooth surface can be more easily worked. The noise of the pump can be reduced, too.

The outer rotor of the pump according to the present invention, which is used in combination with the above-described inner rotor, has a plurality of teeth which are in the shape of an envelope of tooth contours of the inner rotor when the center of the inner rotor is rotated about the center of the outer rotor along a circle having a diameter of (2e+t), while the inner rotor is rotated about the center of the inner rotor by 1/n of one full rotation of the inner rotor every time the center of the inner rotor rotates about the center of the outer rotor.

DESCRIPTION OF NUMERALS

Figure 1:
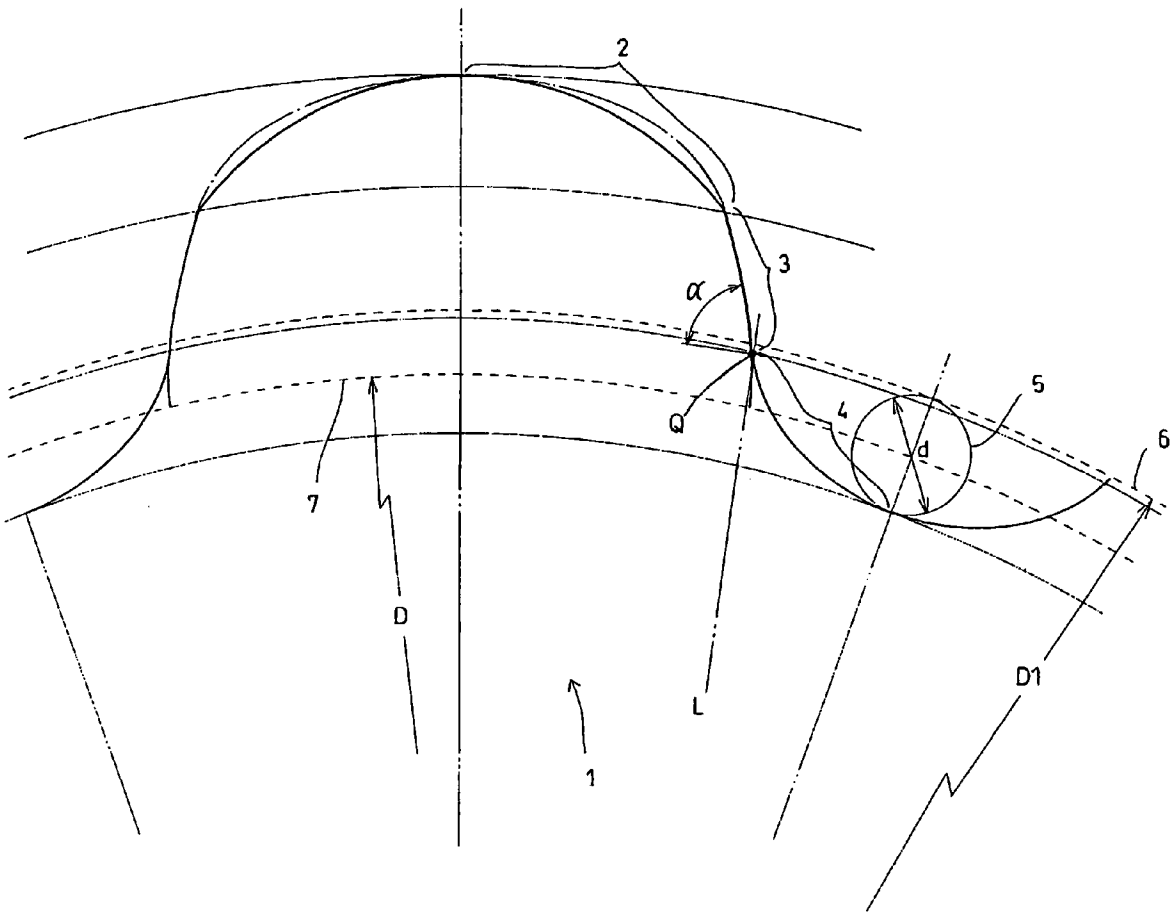
FIG. 1 is an enlarged partial view of an inner rotor according to the present invention, showing one of its teeth.

1 inner rotor
2 tooth top
3 engaging portion
4 tooth bottom
5 rolling circle
6 base circle of hypocycloidal curves
7 base circle of involute curves
8 outer rotor

BEST MODE FOR EMBODYING THE INVENTION

FIG. 1 shows an enlarged view of the inner rotor embodying this invention. In FIG. 1, the inner rotor is generally designated by numeral 1. Each tooth of the inner rotor includes a tooth top 2, an engaging portion 3 that engages the outer rotor, and a tooth bottom 4.

The tooth bottom 4 is defined by hypocycloidal curves, while the engaging portion 3 is defined by involute curves. In the embodiment, the tooth top 2 is defined by a circular curve but may be defined by a part of an oval or an epicycloidal curve as shown by one-dot chain line in FIG. 1.

Each hypocycloidal curve forming the tooth bottom 4 is the locus of a point on a circle 5 having a diameter d when the circle 5 rolls on a base circle 6 having a diameter D1 while being inscribed in the circle 6 without slipping. The base circle (pitch circle) 7 of each involute curve forming the engaging portion 3 has a diameter D that is smaller than the diameter D1 of the base circle 6 of each hypocycloidal curve. The base circles are concentric to each other.

In the embodiment, the tooth top 2 and the tooth bottom 4 have a height and a depth, respectively, that are both slightly less than ⅓ of the entire height of the tooth. Thus, the engaging portion 3 has a height that is slightly greater than ⅓ of the entire height of the tooth. But the engaging portion 3 may have a greater or smaller height.

Such a tooth contour is generated first by determining the position of the surface of the engaging portion 3 (position of the involute curve), and then determining the diameter D1 of the base circle 6 of the hypocycloidal curve and the diameter d of the circle 5 such that the hypocycloidal curve of the tooth bottom 4 is connected to the involute curve at point Q at a desired angle $\alpha$.

The angle $\alpha$ herein referred to is the angle with respect to the line that passes point Q and is perpendicular to the line connecting the common center (not shown) of the base circles 6 and 7 and point Q (which is the line tangent to a circle concentric to the inner rotor at Q). Typically, the inner rotor of an internal gear pump includes 4 to 15 teeth, and preferably, has an inclination angle $\alpha$ of less than 85 degrees and not less than about 65 degrees. In order to maximize the discharge rate of the pump, the inner rotor has preferably about 4 to 12 teeth and has an inclination angle $\alpha$ in the range of 70 to 80 degrees.

The diameters D1 and d of the base circle 6 and the circle 5, which together form the hypocycloidal curve forming the tooth bottom 4 are determined by the diameter of the inner rotor 1, the number and height of the teeth thereof, the pitch of the teeth, the position of the involute curve forming the engaging portion 3, and the inclination angle $\alpha$ at point Q.

The tooth top 2 is preferably formed by an epicycloidal curve as shown by one-dot chain line in FIG. 1 because such a curve can be smoothly connected to the involute curve forming the engaging portion 3. By defining the tooth top 2 with a curve that is smoothly connected to the engaging portion 3, the tooth surface can be more easily worked, and also, it is possible to minimize the gaps of sealing portions of the pump defined between the teeth of the inner and outer rotors, thereby increasing the volumetric efficiency of the pump.

Figure 2:
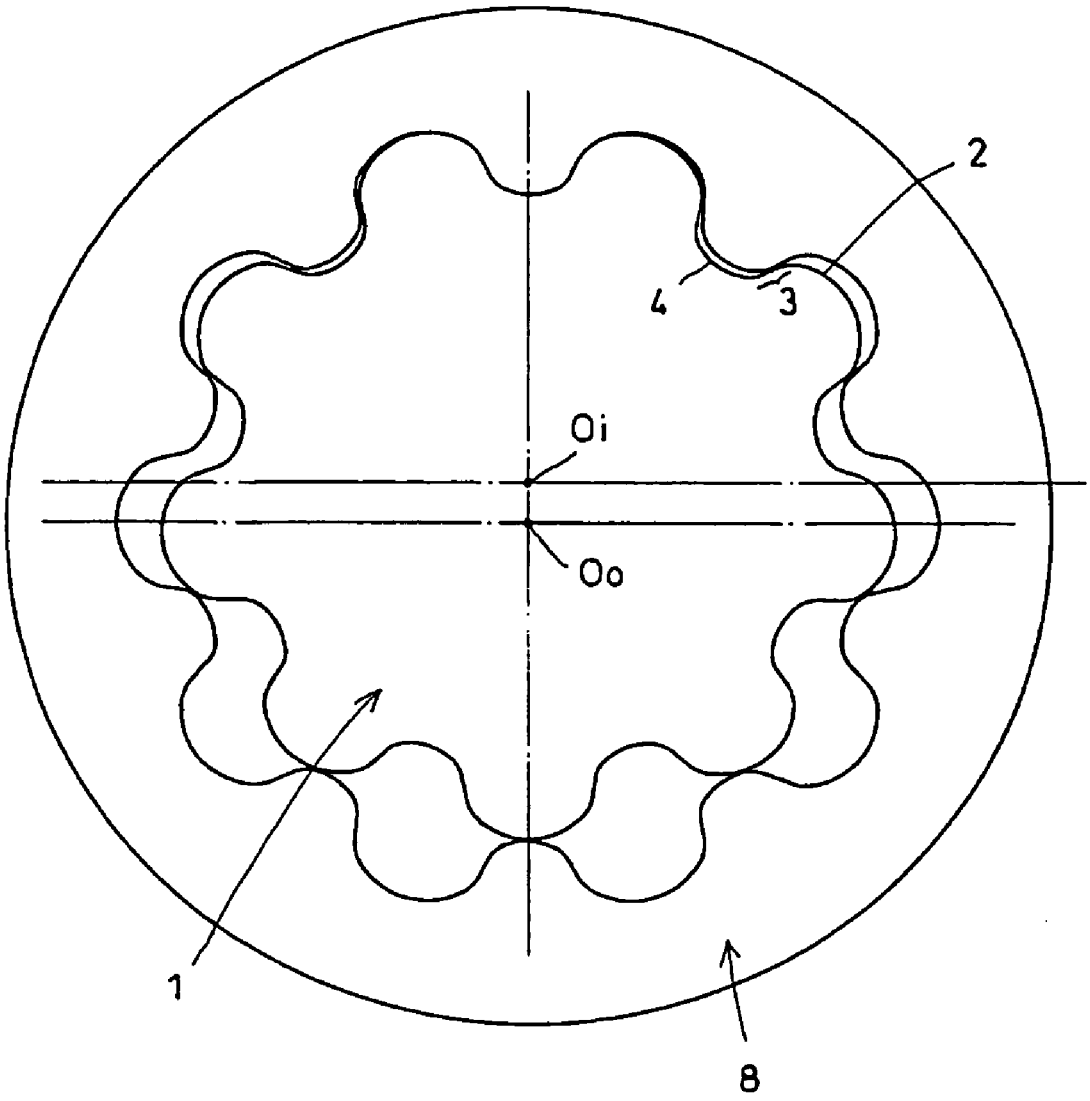
FIG. 2 shows internal gear rotors of a pump according to the present invention.
Figure 3:
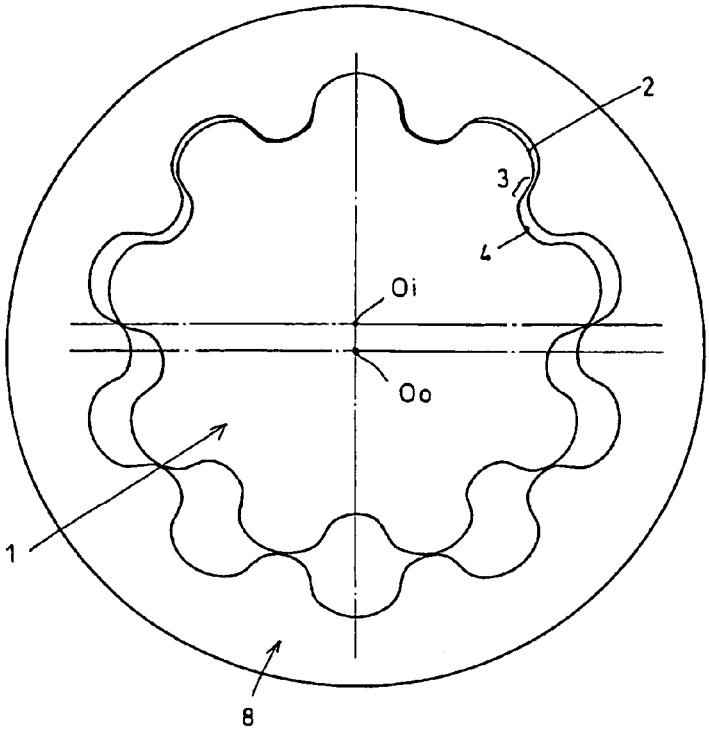
FIG. 3 shows different internal gear rotors of a pump according to the present invention.

FIGS. 2 and 3 show internal gear pumps each including the inner rotor 1 according to the present invention and an outer rotor 8. The pump shown in FIG. 2 is of a type in which the inner rotor 1 and the outer rotor 8 are arranged such that the clearance between a tooth bottom of the inner rotor 1 and a tooth top of the outer rotor 8 will be zero. The pump shown in FIG. 3 is of a type in which the inner rotor 1 and the outer rotor 8 are arranged such that the clearance between a tooth top of the inner rotor 1 and a tooth bottom of the outer rotor 8 will be zero.

The teeth of the outer rotor 8 are formed as follows.

Figure 4:
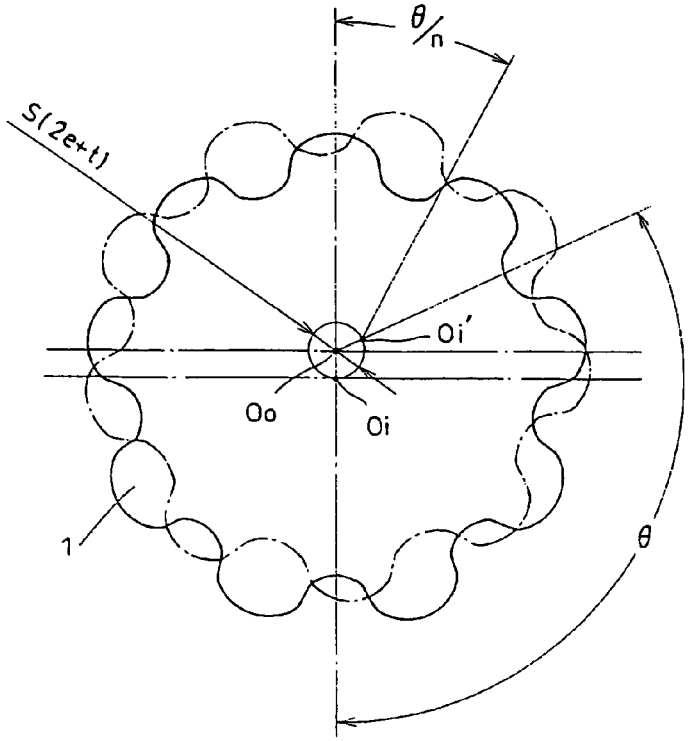
FIG. 4 shows how the tooth contour moves when the center of the inner rotor is rotated while rotating the inner rotor about its center.
Figure 5:
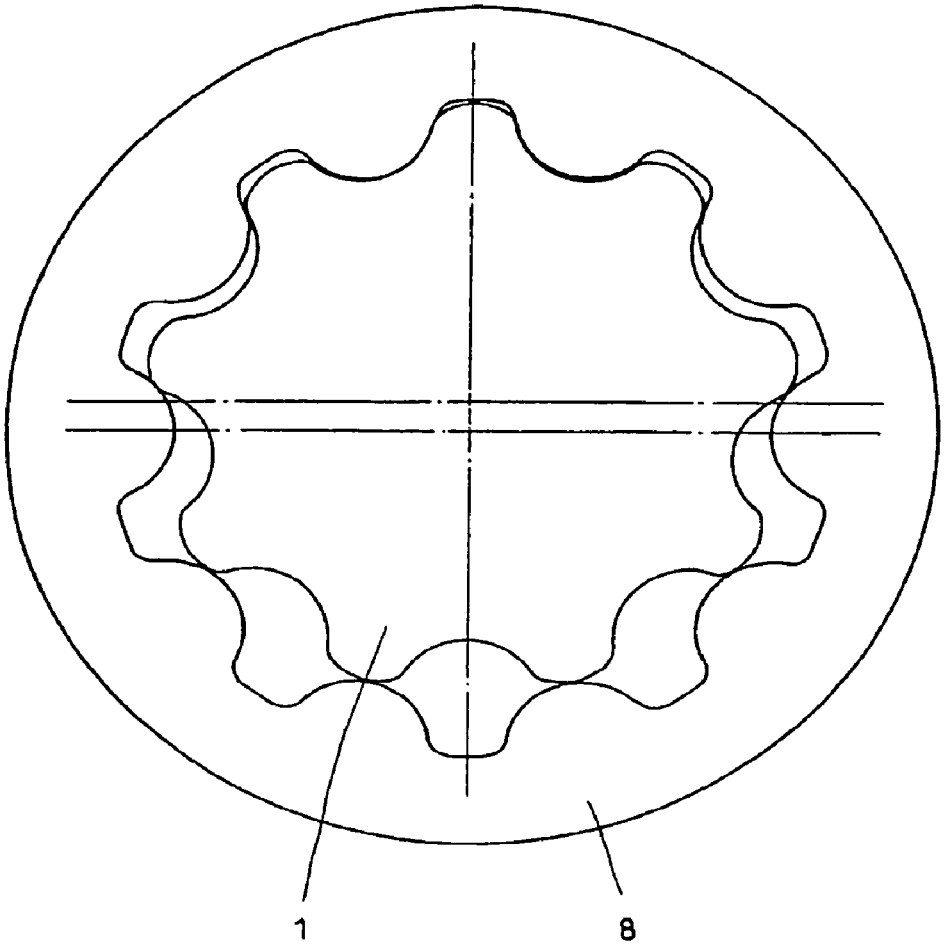
Fig.5 Prior Art
FIG. 5 shows internal gear rotors of a conventional pump.

As shown in FIG. 4, the center Oi of the inner rotor 1 is rotated about the center Oo of the outer rotor 8 along a circle S having a diameter of (2e+t), where t is the maximum clearance defined between the outer rotor 8 and the inner rotor 1 with the inner rotor pressed against the outer rotor.

Every time the center Oi of the inner rotor 1 rotates once about the center Oo of the outer rotor 8, the inner rotor 1 is rotated by 1/n of one full rotation about its center Oi. The one-dot chain line in FIG. 4 shows the tooth contour of the inner rotor 1 when the center Oi of the inner rotor 1 rotates about the center Oo of the outer rotor 8 along the circle S by an angle $\theta$ to point Oi' with the inner rotor 1 rotating about its center Oi by an angle of $\theta/n$. The tooth contour of the outer rotor 8 is formed by an envelope of the tooth contour of the inner rotor at every position thereof when the inner rotor and its center are rotated in the above manner.

In a simulation, the inner rotor and the thus formed outer rotor are meshed together and rotated to check if there is no interference therebetween, and if necessary, the tooth contour of the outer rotor 8 is corrected. Outer rotors having the thus corrected tooth contour are mass-produced.

The outer rotor 8 thus formed is combined with the inner rotor 1 according to the present invention, of which each tooth is formed by three kinds of curves, and they are set in a pump case (not shown) having an inlet port and a discharge port. The internal gear pump according to the present invention is thus assembled.

A performance test was conducted on internal gear pumps having tooth contours shown in FIGS. 2 and 3 (pumps according to the invention) and a conventional internal gear pump having a tooth contour disclosed in Patent document 1 (comparative pump).

Specifications of the pumps according to the invention and the comparative pump are shown below:

Pumps According to the Invention

Number of teeth: 9 (inner rotor) and 10 (outer rotor)

Dimensions: 94.0 mm in outer diameter by 10.8 mm in thickness

Eccentricity e: 4.2 mm

Comparative Pump

Number of teeth: 9 (inner rotor) and 10 (outer rotor)

Dimensions: 94.0 mm in outer diameter by 10.8 mm in thickness

Eccentricity e: 3.735 mm

Figure 6:
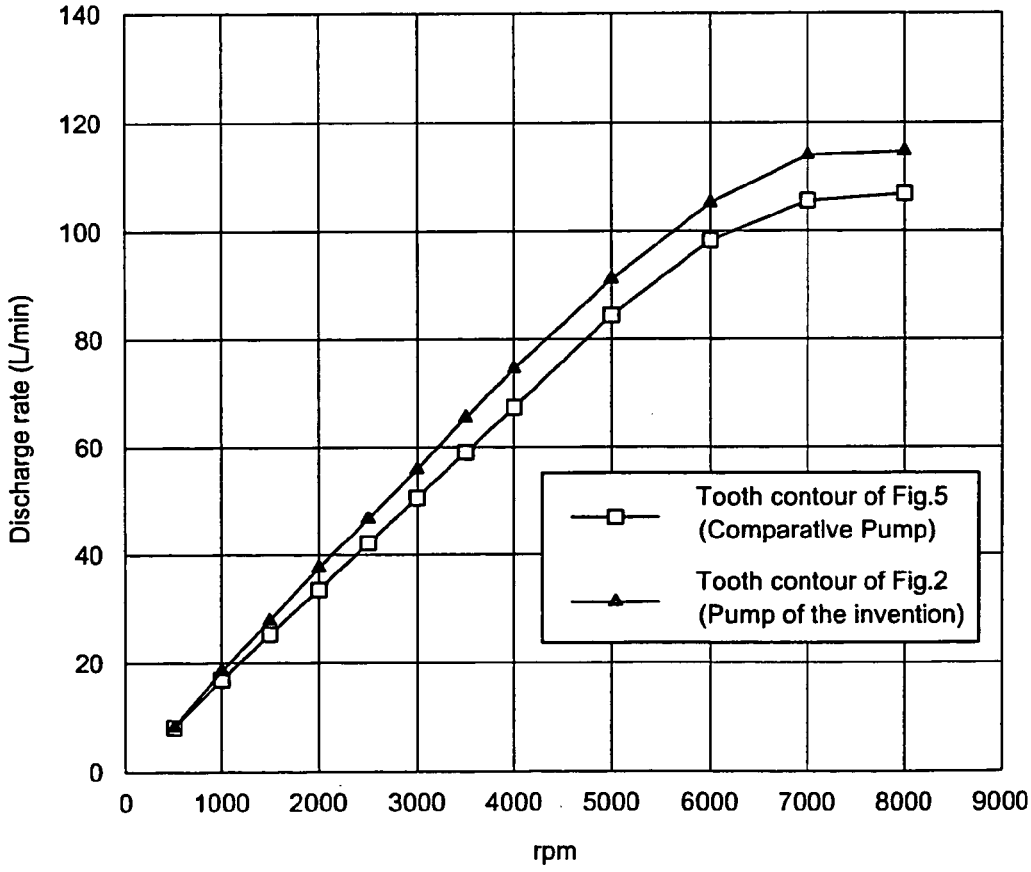
FIG. 6 shows the results of a comparative test on the relationship between the number of revolutions of the rotors and the discharge rate.

The performance test was conducted at an oil temperature of 80 degrees C. and a discharge pressure of 0.50 MPa. FIG. 6 shows the results of the test, i.e. the relationship between the rotor revolutions and the discharge rate.

As is apparent from the test results, the pumps according to the invention have a greater eccentricity, and thus are higher in discharge rate than the comparative pump in spite of the fact that the pumps according to the invention are equal in the rotor outer diameter and thickness to the comparative pump.

The invention claimed is:

1. An internal pump comprising an inner rotor of an internal gear pump comprising said inner rotor and an outer rotor, said inner rotor having a plurality of first teeth and said outer rotor having a plurality of second teeth, said plurality of second teeth being greater in number by one than said plurality of first teeth, said first teeth each comprising a tooth bottom defined by two hypocycloidal curves connected to the tooth bottoms of the two first teeth adjacent said each first tooth, respectively, an engaging portion configured to engage said outer rotor and defined by involute curves, and a tooth top defined by a predetermined curve, and said outer rotor having a plurality of teeth which are in the shape of an envelope of tooth contours of said inner rotor when the center of said inner rotor is rotated about the center of said outer rotor along a circle having a diameter of (2e+t), where e is the distance between the centers of said inner rotor and said outer rotor, and t is a maximum gap defined between said outer rotor and said inner rotor when said inner rotor is pressed against said outer rotor, while said inner rotor is rotated about the center of the inner rotor by 1/n, where n is the number of teeth of the inner rotor, of one full rotation of said inner rotor every time the center of said inner rotor rotates once about the center of said outer rotor.

2. An internal pump comprising an inner rotor of an internal gear pump comprising said inner rotor and an outer rotor, said inner rotor having a plurality of first teeth and said outer rotor having a plurality of second teeth, said plurality of second teeth being greater in number by one than said plurality of first teeth, said first teeth each comprising a tooth bottom defined by two hypocycloidal curves connected to the tooth bottoms of the two first teeth adjacent said each first tooth, respectively, an engaging portion configured to engage said outer rotor and defined by involute curves, and a tooth top defined by a predetermined curve, and said outer rotor having a plurality of teeth which are in the shape of an envelope of tooth contours of said inner rotor when the center of said inner rotor is rotated about the center of said outer rotor along a circle having a diameter of (2e+t), where e is the distance between the centers of said inner rotor and said outer rotor, and t is a maximum gap defined between said outer rotor and said inner rotor when said inner rotor is pressed against said outer rotor, while said inner rotor is rotated about the center of the inner rotor by 1/n, where n is the number of teeth of the inner rotor, of one full rotation of said inner rotor every time the center of said inner rotor rotates once about the center of said outer rotor, wherein a base circle of said hypocycloidal curves has a diameter greater than a base circle of said involute curves, each of said hypocycloidal curves of said tooth bottom connecting with one of said involute curves of said engaging portion at a point inside of the base circle of said hypocycloidal curves, and wherein a tangent, at said point, to a circle having a center at the center of the inner rotor and passing said point forms an angle smaller than 85 degrees with respect to a tangent to the involute curve at said point.

3. An internal pump comprising an inner rotor of an internal gear pump comprising said inner rotor and an outer rotor, said inner rotor having a plurality of first teeth and said outer rotor having a plurality of second teeth, said plurality of second teeth being greater in number by one than said plurality of first teeth, said first teeth each comprising a tooth bottom defined by two hypocycloidal curves connected to the tooth bottoms of the two first teeth adjacent said each first tooth, respectively. an engaging portion configured to engage said outer rotor and defined by involute curves, and a tooth top defined by a predetermined curve, and said outer rotor having a plurality of teeth which are in the shape of an envelope of tooth contours of said inner rotor when the center of said inner rotor is rotated about the center of said outer rotor along a circle having a diameter of (2e+t), where e is the distance between the centers of said inner rotor and said outer rotor, and t is a maximum gap defined between said outer rotor and said inner rotor when said inner rotor is pressed against said outer rotor, while said inner rotor is rotated about the center of the inner rotor by 1/n, where n is the number of teeth of the inner rotor, of one full rotation of said inner rotor every time the center of said inner rotor rotates once about the center of said outer rotors, wherein said predetermined curve defining the tooth top is an epicycloidal curve.

4. An internal pump comprising an inner rotor of an internal gear pump comprising said inner rotor and an outer rotor, said inner rotor having a plurality of first teeth and said outer rotor having a plurality of second teeth, said plurality of second teeth being greater in number by one than said plurality of first teeth, said first teeth each comprising a tooth bottom defined by two hypocycloidal curves connected to the tooth bottoms of the two first teeth adjacent said each first tooth, respectively, an engaging portion configured to engage said outer rotor and defined by involute curves, and a tooth top defined by a predetermined curve, and said outer rotor having a plurality of teeth which are in the shape of an envelope of tooth contours of said inner rotor when the center of said inner rotor is rotated about the center of said outer rotor along a circle having a diameter of (2e+t), where e is the distance between the centers of said inner rotor and said outer rotor, and t is a maximum gap defined between said outer rotor and said inner rotor when said inner rotor is pressed against said outer rotor, while said inner rotor is rotated about the center of the inner rotor by 1/n, where n is the number of teeth of the inner rotor, of one full rotation of said inner rotor every time the center of said inner rotor rotates once about the center of said outer rotors wherein a base circle of said hypocycloidal curves has a diameter greater than a base circle of said involute curves, each of said hypocycloidal curves of said tooth bottom connecting with one of said involute curves of said engaging portion at a point inside of the base circle of said hypocycloidal curves, and wherein a tangent, at said point, to a circle having a center at the center of the inner rotor and passing said point forms an angle smaller than 85 degrees with respect to a tangent to the involute curve at said point, and wherein said predetermined curve defining the tooth top is an epicycloidal curve.

* * * * *